US005269528A

United States Patent [19]

McCardle, Jr.

[11] Patent Number: 5,269,528

[45] Date of Patent: Dec. 14, 1993

[54] GOLF SWING TRAINING METHOD

[76] Inventor: Robert J. McCardle, Jr., 319 S. Beltline Blvd. #2F, Columbia, S.C. 29205

[21] Appl. No.: 969,105

[22] Filed: Oct. 30, 1992

[51] Int. Cl.[5] ..... A63B 69/36

[52] U.S. Cl. ..... 273/186.3; 273/193 A; 434/252

[58] Field of Search ..... 273/186.3, 35 R, 189 R, 273/188 R, 193 R, 193 A, 193 B; 434/252

[56] References Cited

U.S. PATENT DOCUMENTS

| | | | |
|---|---|---|---|
| 3,109,244 | 11/1963 | Trifaro et al. | 273/35 R X |
| 3,384,741 | 5/1968 | Bice | 273/186.3 |
| 3,820,781 | 6/1974 | Kane | 273/35 R X |
| 3,863,933 | 2/1975 | Tredway | 273/186.3 |
| 4,456,257 | 6/1984 | Perkins | 273/186.3 |
| 4,971,328 | 11/1990 | Hernberg | 273/186.3 |

*Primary Examiner*—George J. Marlo
*Attorney, Agent, or Firm*—B. Craig Killough

[57] ABSTRACT

A golf training device having a shaft with a lighting means located in each end of the shaft, with a light beam emitted from each lighting means away from the shaft, with each beam of light on a line with the other beam of light. A method of using the golf training device through a typical golf swing by locating a beam of light emitted from a lower end of the shaft on a line defined by an imaginary object ball and an imaginary target, with the light beam traveling along the line at appropriate points in the swing, and with the beam of light emitted from the opposite end of the shaft striking and traveling along the line at appropriate points in the swing. The device may also be used to achieve proper rotation of the hips and torso during the golf swing by using one's arms to hold the shaft against one's chest or lower torso while rotating one's body rearward and forward as in a typical golf club swing and observing the locations of the light beams emitted from the opposite ends of the shaft.

1 Claim, 5 Drawing Sheets

GOLF SWING TRAINING METHOD

BACKGROUND OF THE INVENTION

The present invention relates to sports and sporting goods generally, and is more specifically directed to a device which can be used for training a person to achieve a proper golf swing.

Golf is a widely engaged in sport and game. A club is used to strike a golf ball, and the precision with which the head of the club strikes the golf ball determines the distance which the ball travels, and the accuracy with which the ball is driven toward the target.

Many variables enter into the mechanics of a proper golf swing. A proper golf swing requires proper dynamic positioning of the hands, the arms, the legs, the torso, the head, and the feet. Other variables are introduced in the dynamic positioning of the muscles which control the body. It takes much precise positioning and practice to achieve the most desirable golf swing.

SUMMARY OF THE INVENTION

The present invention is a device which allows a user to develop a proper golf swing by using the device and the method described herein. The device allows the user to visualize the mechanics of a proper golf swing through the use of the device, and by repeated use of the device, the user develops muscle memory which results in a proper golf swing when a golf club, rather than the training device, is used.

Briefly, the present invention comprises a shaft having lighting means positioned on opposite ends thereof. A beam of light is emitted from a first end of the shaft away from the shaft, and a beam of light is emitted from an opposite end of the shaft away from the shaft. The beams of light so emitted are on the same line, and are generally on line with the longitudinal axis of the shaft.

The device may be used by multiple methods. A first method is used to achieve proper rotation of the body by holding the device against the chest as will be seen, and rotating the torso, but not the arms, through the golf swing. Likewise, the device may be held against the lower torso, while rotating the hips through the golf swing, as will be seen.

The shaft of the device may be gripped like a golf club. A beam of light emitted from the lower end of the shaft is directed at a line which extends in front of and in back of the point directly in front of user. The line is defined by the position of an imaginary object ball and an imaginary target.

As the user begins the back swing, the beam of light emitted from the lower end of the shaft will, according to the method, remain on the line, and as the user continues through the back swing, the beam of light emitted from the upper end of the shaft will strike the line and continue on the line. As the user begins the swing toward the point, which corresponds to the location of a golf ball, the upper beam of light will continue to follow the line, and as the lower end of the shaft starts toward the ball, its light will strike the line and follow the line. As the user continues the swing to follow through, the light emitted from the upper end will again strike the line and follow the line. When this method is used, a proper golf swing is achieved.

DESCRIPTION OF THE PREFERRED EMBODIMENT

Figure 1:
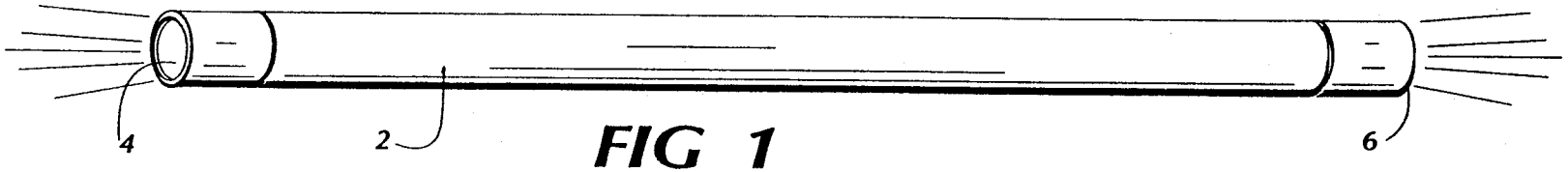
FIG. 1 shows the golf training device, with a shaft, and a lighting means on an end and a second end thereof.

Referring now to the drawings, FIG. 1 shows a golf training device. The device comprises a shaft 2 which will have a round cross section like a golf club in the preferred embodiment. The device is elongated, that is, it has a relatively extended length when compared to the cross section. In the preferred embodiment the cross section is round. While most golf clubs are tapered, that is, the cross section is decreasing from one end to the other, the device is of a constant cross section.

In the preferred embodiment the device is hollow. The device may be made of virtually any relatively rigid material such as fiberglass, metal, or plastic. If the shaft is hollow, the shaft will conveniently house the lighting means which is required on each end of the device.

A lighting means is present on each end of the shaft. A first lighting 4 means is present so as to direct a beam of light away from the shaft, and a second lighting means 6 is present which also directs a beam of light away from the shaft. It is critical to the invention that the respective beams of light are on a line with each other. Accordingly, in the most common configuration, the shaft will be straight, and will have a longitudinal axis which is generally on line with the line created by the beams of light.

Virtually any lighting means could be used which will allow the device to be used to perform a golf swing of the type depicted in drawing FIGS. 4A–4J. A simple flashlight will perform the function of the lighting means. A simple flashlight is made up of an incandescent bulb capable of being powered by a relatively low voltage direct current source, such as a flashlight battery. However, virtually any lighting means which will generate a beam of light equal to that of a typical flashlight could be used. It is desirable, however, that the beam of light has low dispersion so that the light locates on the line 8 as precisely as possible.

Figure 2C:
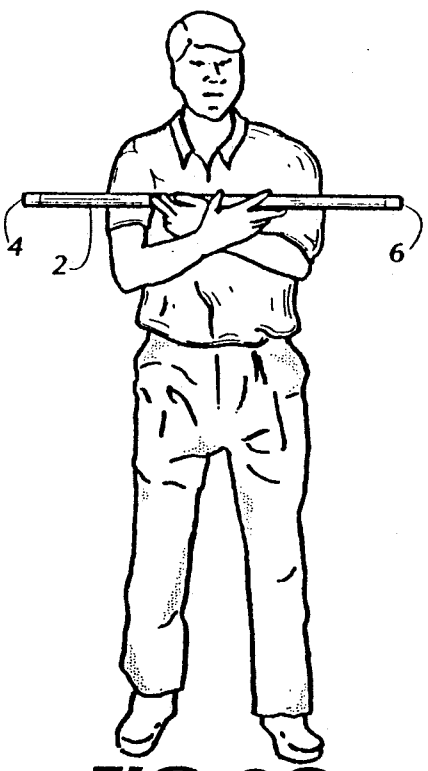
FIGS. 2A–FIG. 2D show a method of using the golf training device to achieve the proper rotation of the torso through a golf swing.
Figure 2D:
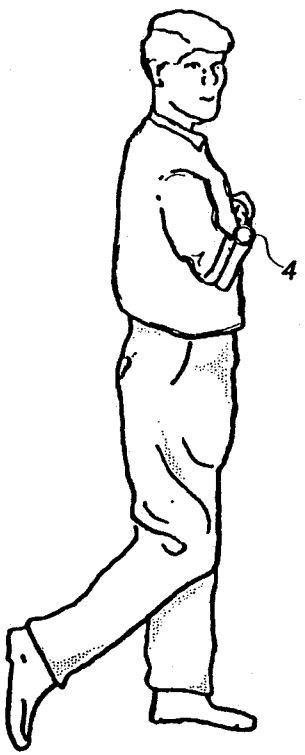
Figure 2B:
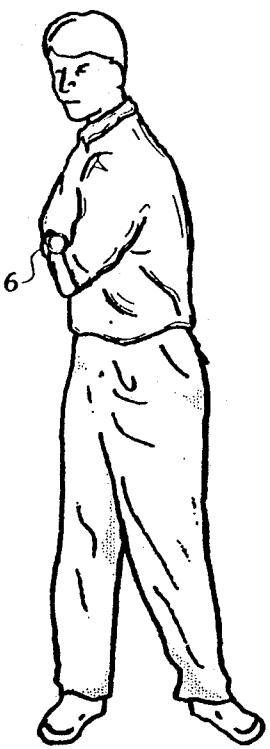
Figure 2A:
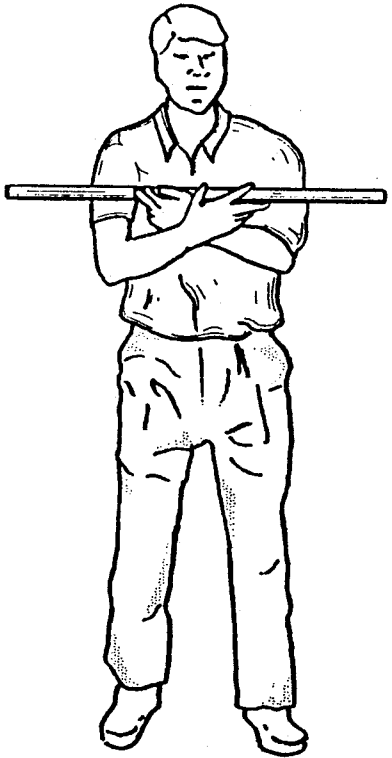

A first method of using the device is shown in FIGS. 2A–2D. The device is placed against the chest, with the arms crossed and folded as in FIG. 2A. The device is parallel to the ground, so that a beam of light emitted from each of the lighting means is also parallel to the ground. The device is perpendicular to the user's spine. The user begins rotation of the body as is typical in a golf swing. When the user reaches the position as shown in FIG. 2B, the left shoulder of the user, for a right handed user, is lower than the right shoulder. By looking at where the light beam points, or by using mirrors appropriately placed, or through the use of a video camera, the user can demonstrate that the beam of light emitted from the end of the device at the left shoulder is lower than at the right shoulder. As the user rotates the torso back to the position shown in FIG. 2C, the device is again parallel to the ground, as is demonstrated by the beam of light emitted from each end of the device. As the user rotates the torso to the position shown in FIG. 2D, the right shoulder is lower than the left shoulder, again as demonstrated by the beam of light emitted from each end. An additional and important point is demonstrated by the method and the device. The end 6 of the device which is in front of the user as shown in 2B is behind the user in 2D. However, the beam of light in FIG. 2B strikes the same plane as the beam light emitted from the opposite end 4 when rotated to the position shown in FIG. 2D. Each end will, in FIG. 2B, strike the same plane as the opposite end when the user rotates to the position shown in FIG. 2D when proper torso rotation is achieved.

The device may also be used to demonstrate proper rotation of the hips. The use of the device to achieve proper rotation of the hips is shown in FIGS. 3A–3D. The principle is exactly the same as that demonstrated in FIGS. 2A–2D.

Figure 3A:
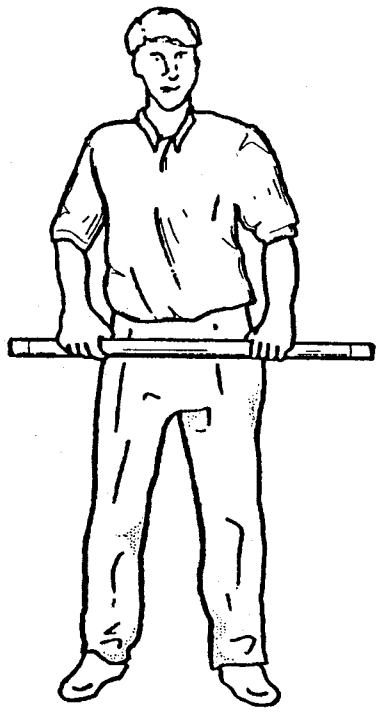
FIGS. 3A–FIG. 3D show a method of using the device to achieve proper rotation of the hips through a golf swing.
Figure 3B:
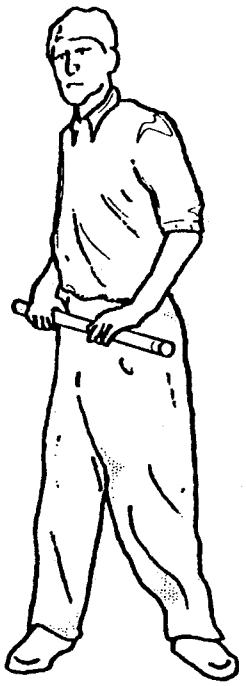
Figure 3C:
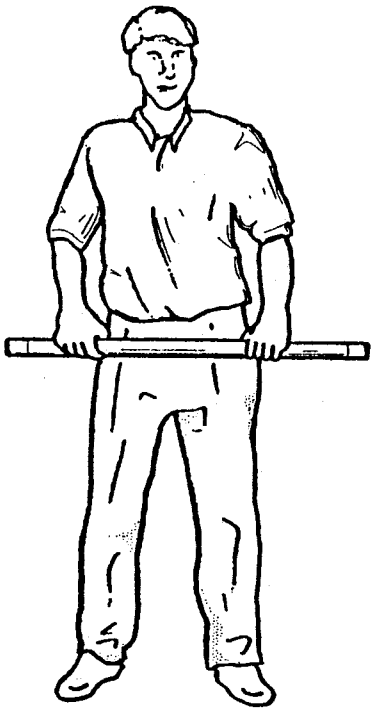
Figure 3D:
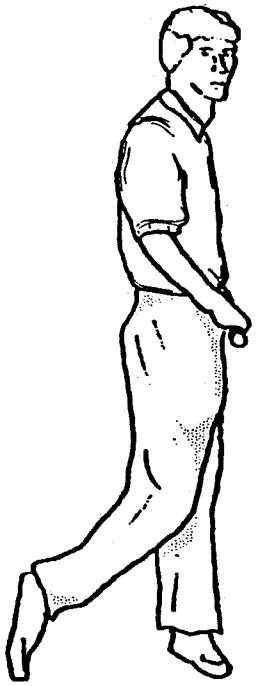

The device is located against the lower torso as shown in FIG. 3A, and the user rotates through the golf swing as shown in FIGS. 3B–3D. As the user rotates to the position shown in FIG. 3B, the left hip is lower than the right hip. As the user continues to the position shown in FIG. 3C, the device is then again parallel to the ground. As the user continues to the position shown in 3D, the right hip is lower than the left hip.

Figure 4C:
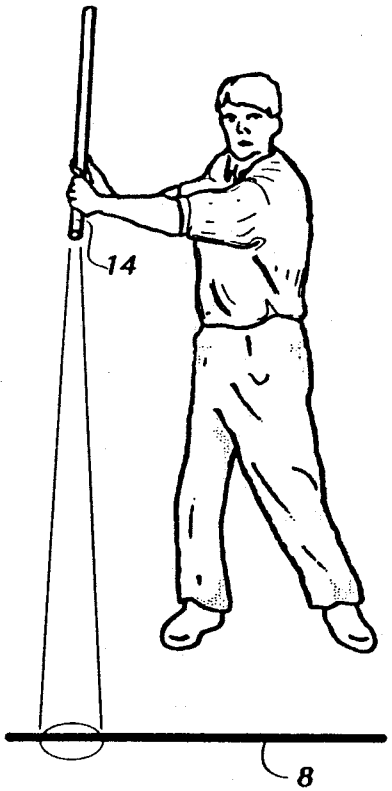
FIGS. 4A–FIG. 4J show a method of using the device to achieve a proper golf swing.
Figure 4B:
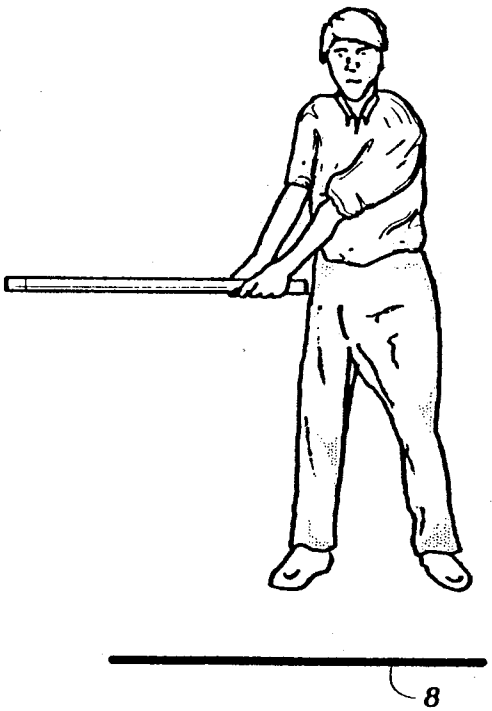
Figure 4A:
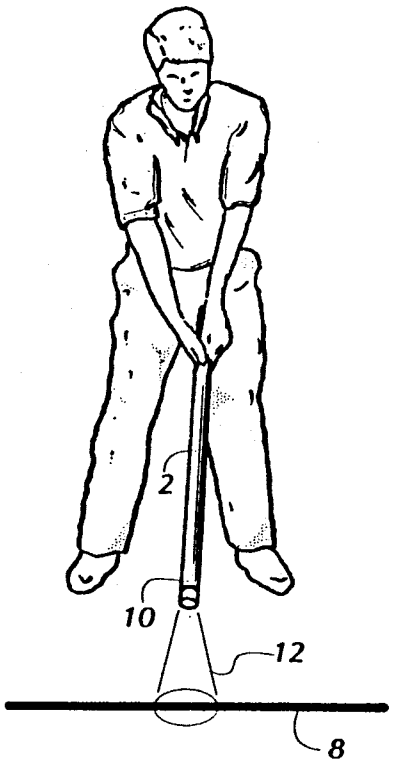
Figure 4G:
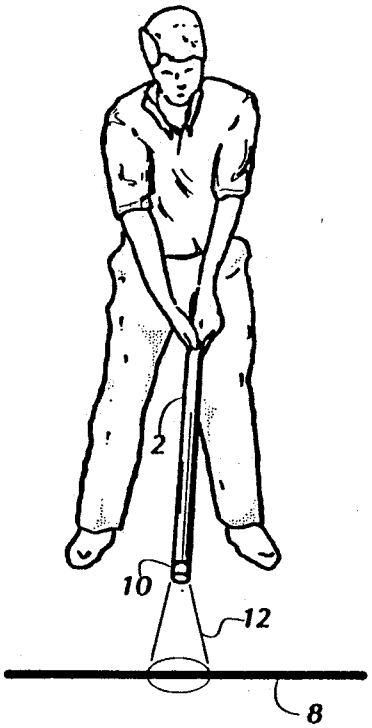
Figure 4F:
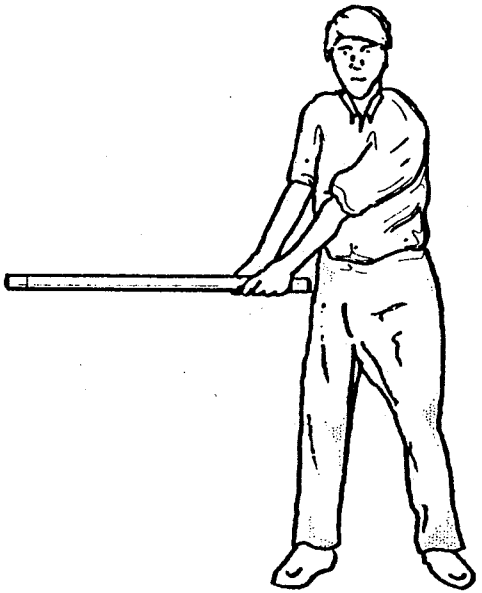
Figure 4E:
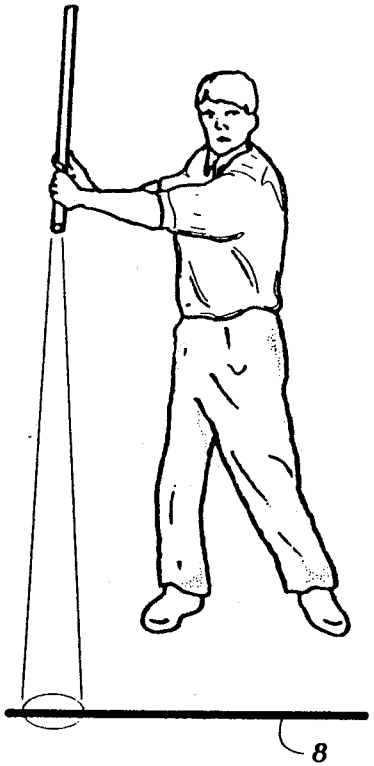

FIGS. 4A–4J demonstrate the use of the device in instructing the user in a proper golf swing. As shown in FIG. 4A, a user grips the device near an upper end of the shaft. The user grips the device with a proper grip as if the device were a golf club. At all times in FIGS. 4A–4J, the device is perpendicular to line 8.

Line 8 is physically drawn on the ground. The line is defined by a point which corresponds to an object golf ball and a point which corresponds to a target. In most instances, the device will be used indoors, and of course, there will be no object golf ball, nor an actual target. Accordingly, an imaginary target is chosen, and a line is drawn which extends in front of and behind of the point, with the imaginary target on line with the point.

The user holds the shaft 2 of the device with the proper grip and with the lower end 10 of the shaft a few inches from the ground. A beam of light 12 is emitted from the lighting means on the lower end of the shaft as shown in FIG. 4A, and the beam of light is directed at the line.

The user now begins his or her golf swing, as shown in FIG. 4B. As the user begins this back swing, the device and the method indicate proper back swing when the beam of light emitted from the lower end to travel along the line until the lower end 10 reaches a point of elevation so that it no longer strikes the floor. The lower end has reached such a point of elevation in FIG. 4B. It is noted that the beam of light from end 4 strikes the left pelvis of the user in this position.

As the user continues the back swing, the beam of light from the lighting means which is located in the opposite end 14 strikes the floor or ground. FIG. 4C. As the method demonstrates, in a proper golf swing, the beam of light from the lighting means in end 14 which is closest to the user's hands will also travel along the line 8 as the back swing continues.

Figure 4D:
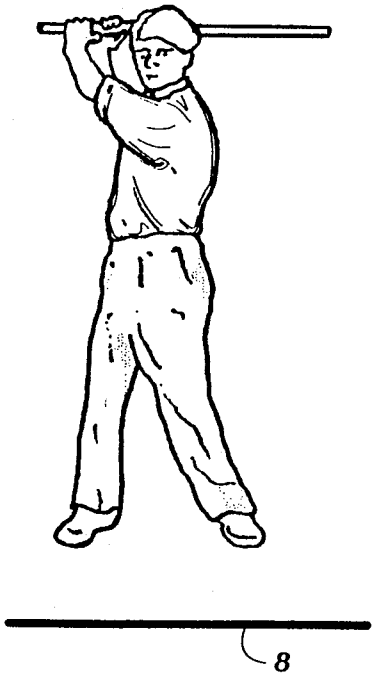

The maximum back swing is shown in FIG. 4D. As the beam of light from the lighting means located in the end 14 of the shaft nearest the user's hands strikes the floor, the beam of light will again strike the line and travel along the line as the swing continues until the device reaches a point of elevation so that the beam of light no longer strikes the floor. Such an elevation has been reached in FIG. 4F, which is substantially the same as the position of FIG. 4B.

The user's swing continues through until the beam of light from the lighting means located in the lower end 10 of the shaft strikes the floor. Again, the beam of light will strike and travel along the line. This is demonstrated in FIG. 4G, which shows the position of the shaft 2 at a point where a golf club would strike a golf ball.

Figure 4J:
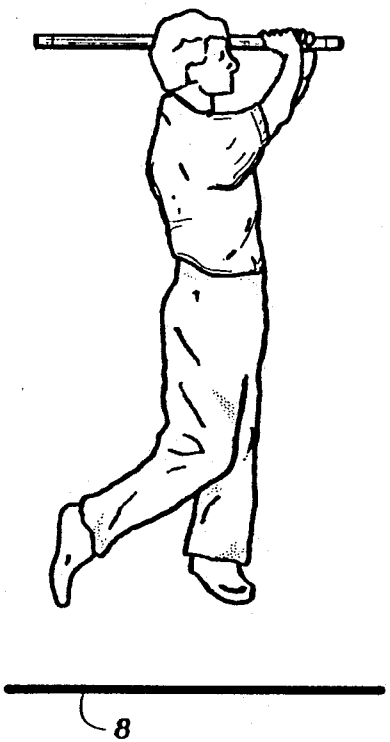
Figure 4I:
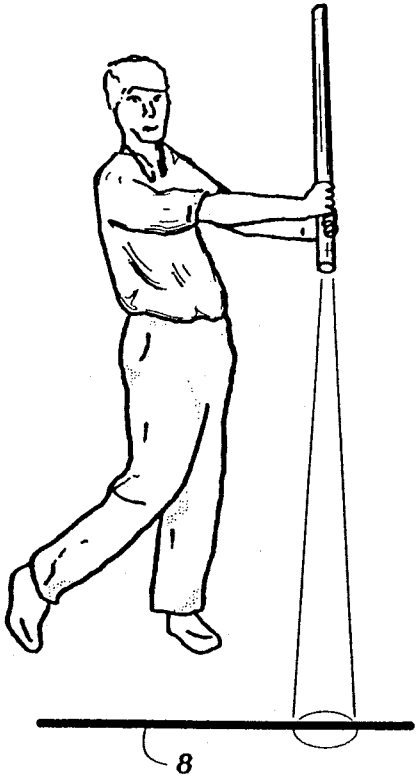
Figure 4H:
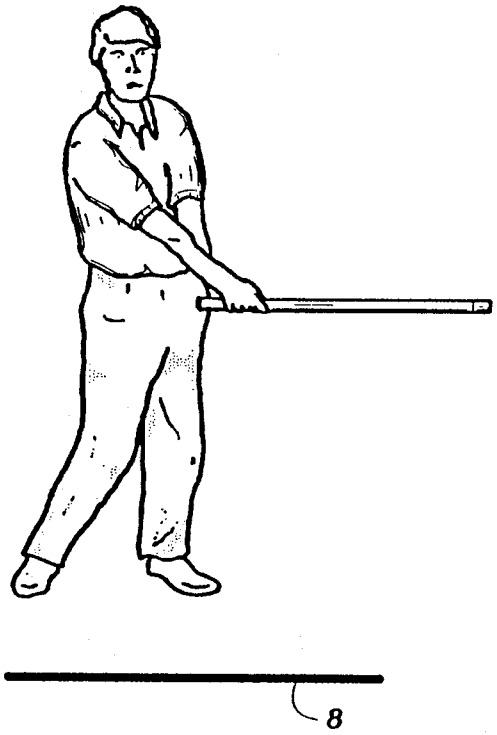

The user continues to swing through as shown in FIG. 4H until a point of elevation of the respective lighting means such that the shaft is generally parallel to the floor, and neither light strikes the floor. The light beam from end 14 strikes the left pelvis of the user in this position. As the user continues through the golf swing, the beam of light from the lighting means in end 14 strikes the floor, and once again, a proper golf swing is achieved by the method when the beam of light is focused upon and travels along the line. FIG. 4I. The user continues through the swing to the point of complete follow through of the swing as shown in FIG. 4J.

In summary of the method demonstrated by drawing FIGS. 4, in a proper golf swing, a line is defined between each end of the golf club and a line defined by a target, which is usually the hole, and a point which is defined by the position of the ball. The device, when used according to the method of FIGS. 4, demonstrates the travel of a golf club through a proper golf swing by transforming the imaginary line from each end of the club to line 8 into a beam of light which strikes and travels along line 8.

The device can be used repeatedly to train a user in a proper golf swing. Through muscle memory, practice training will be converted into actual use on the golf course or driving range with an actual golf club and golf ball.

The device also has the capability of aiding a user in achieving proper torso rotation as shown in FIGS. 2, and proper hip rotation as shown in FIGS. 3.

What is claimed is:

1. A method of achieving a proper golf swing comprising:

a. using an elongated shaft including means for projecting a light beam outwardly from the first and second ends of said shaft in opposite directions along the longitudinal axis of said shaft;

b. using one's arms to hold said shaft against one's chest or lower torso with the longitudinal axis of said shaft in a first beginning position parallel to a surface on which one is standing and perpendicular to one's spine while standing in a golf ball address position;

c. rotating one's chest or torso from said first beginning position as in a typical backswing to a second position which is displaced a substantial angle rearward from said address position wherein the first end of said shaft is lower than the second end thereof; and d. rotating one's chest or torso in an opposite forward direction as in a typical downswing though said first beginning position to a final position which is displaced a substantial angle past said first beginning position and said second end of said shaft is lower than said first end, and wherein said beam of light from said first end and said beam of light from said second end follow a common line as each light beam rotates through a common series of positions.

* * * * *